US007946122B2

(12) United States Patent
Kim

(10) Patent No.: US 7,946,122 B2
(45) Date of Patent: May 24, 2011

(54) AIR COOLING DEVICE OF INTEGRATED THERMO-HYGROSTAT

(76) Inventor: Jae Gon Kim, Kwangmyong (KR)

( * ) Notice: Subject to any disclaimer, the term of this patent is extended or adjusted under 35 U.S.C. 154(b) by 156 days.

(21) Appl. No.: 12/447,458

(22) PCT Filed: Oct. 25, 2007

(86) PCT No.: PCT/KR2007/005270
§ 371 (c)(1),
(2), (4) Date: Apr. 27, 2009

(87) PCT Pub. No.: WO2008/051026
PCT Pub. Date: May 2, 2008

(65) Prior Publication Data

US 2010/0043482 A1 Feb. 25, 2010

(30) Foreign Application Priority Data

Oct. 27, 2006 (KR) ..... 10-2006-0104832

(51) Int. Cl.
*F25B 49/00* (2006.01)

(52) U.S. Cl. ..... 62/176.1; 62/187; 62/498

(58) Field of Classification Search ..... 62/176.1, 62/186, 187, 407, 408, 498, 91, 271, 304; 165/223, 225, 229; 261/129, 139
See application file for complete search history.

(56) References Cited

U.S. PATENT DOCUMENTS

| | | | | |
|---|---|---|---|---|
| 3,572,052 | A * | 3/1971 | Toth | 62/278 |
| 3,772,896 | A * | 11/1973 | Rao | 62/79 |
| 4,700,550 | A * | 10/1987 | Rhodes | 62/271 |
| 5,460,004 | A * | 10/1995 | Tsimerman | 62/94 |
| 6,895,774 | B1 * | 5/2005 | Ares et al. | 62/332 |
| 7,055,262 | B2 * | 6/2006 | Goldberg et al. | 34/86 |
| 7,062,938 | B2 * | 6/2006 | Lee | 62/506 |
| 7,322,205 | B2 * | 1/2008 | Bourne et al. | 62/305 |
| 2002/0083725 | A1 * | 7/2002 | Renken et al. | 62/132 |
| 2004/0040322 | A1 * | 3/2004 | Engel et al. | 62/177 |
| 2005/0198995 | A1 * | 9/2005 | Lee | 62/506 |

FOREIGN PATENT DOCUMENTS

| | | |
|---|---|---|
| JP | 05-039936 | 2/1993 |
| JP | 05-292869 | 9/1993 |
| KR | 10-2003-0057491 | 7/2003 |

* cited by examiner

*Primary Examiner* — Mohammad M Ali
(74) *Attorney, Agent, or Firm* — Christopher Paul Mitchell

(57) ABSTRACT

The present invention provides an air cooling device of an integrated thermo-hygrostat, which is advantageous over known integrated thermo-hygrostats in that it is possible to prevent indoor air from being mixed with cold outdoor air when cooling an indoor space using the cold outdoor air in winter by installing an indoor air control damper which can control the flow of the indoor air in front of an evaporator installed in an inner portion of a main body. The air cooling device can rapidly lower the temperature of the indoor space to the intended temperature, increase cooling efficiency, and prevent power from being unnecessarily consumed by being capable of suspending the cooling function thereof when cooling is performed using outdoor air having a temperature below a predetermined temperature.

6 Claims, 7 Drawing Sheets

[Fig. 1]
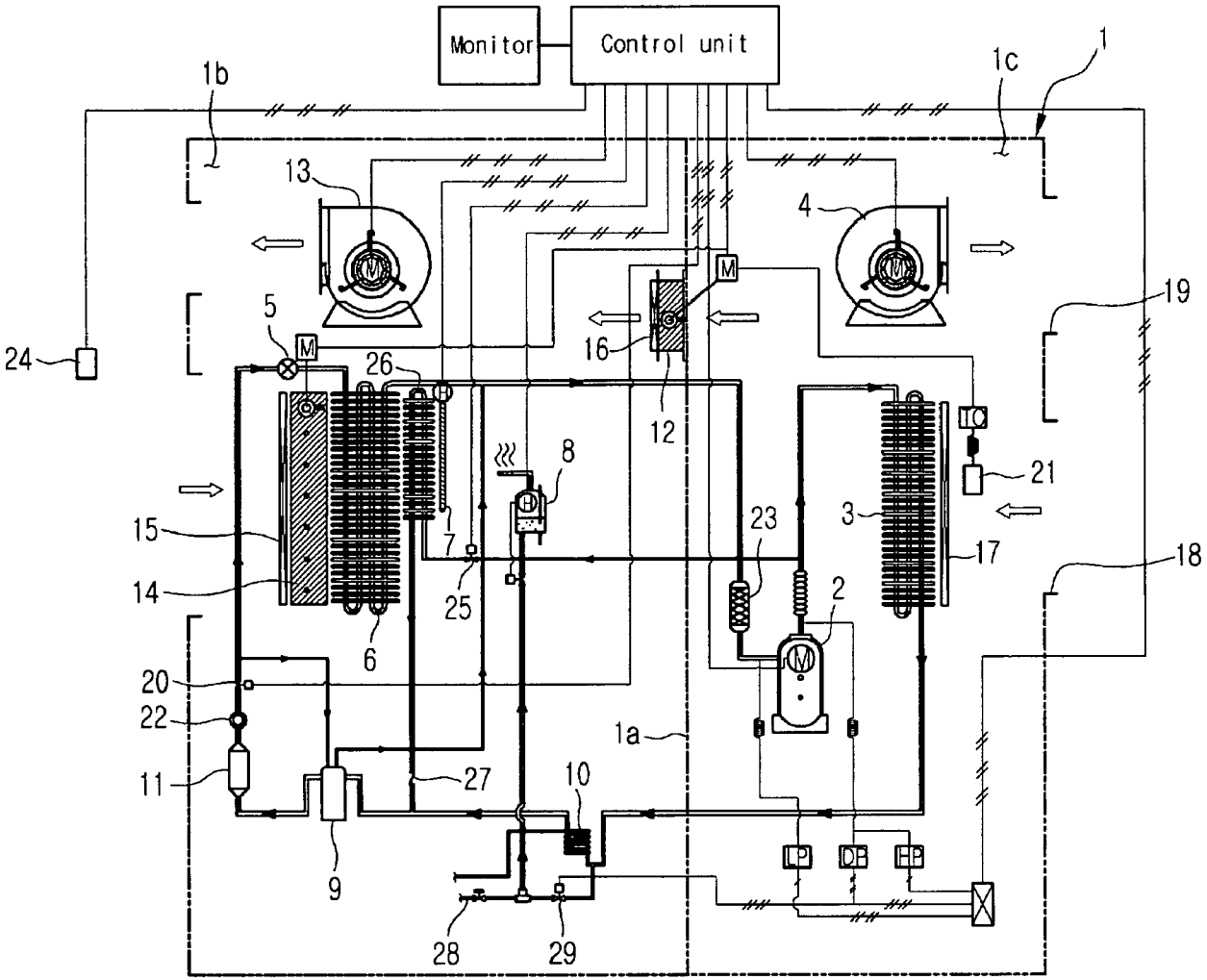

[Fig. 2]
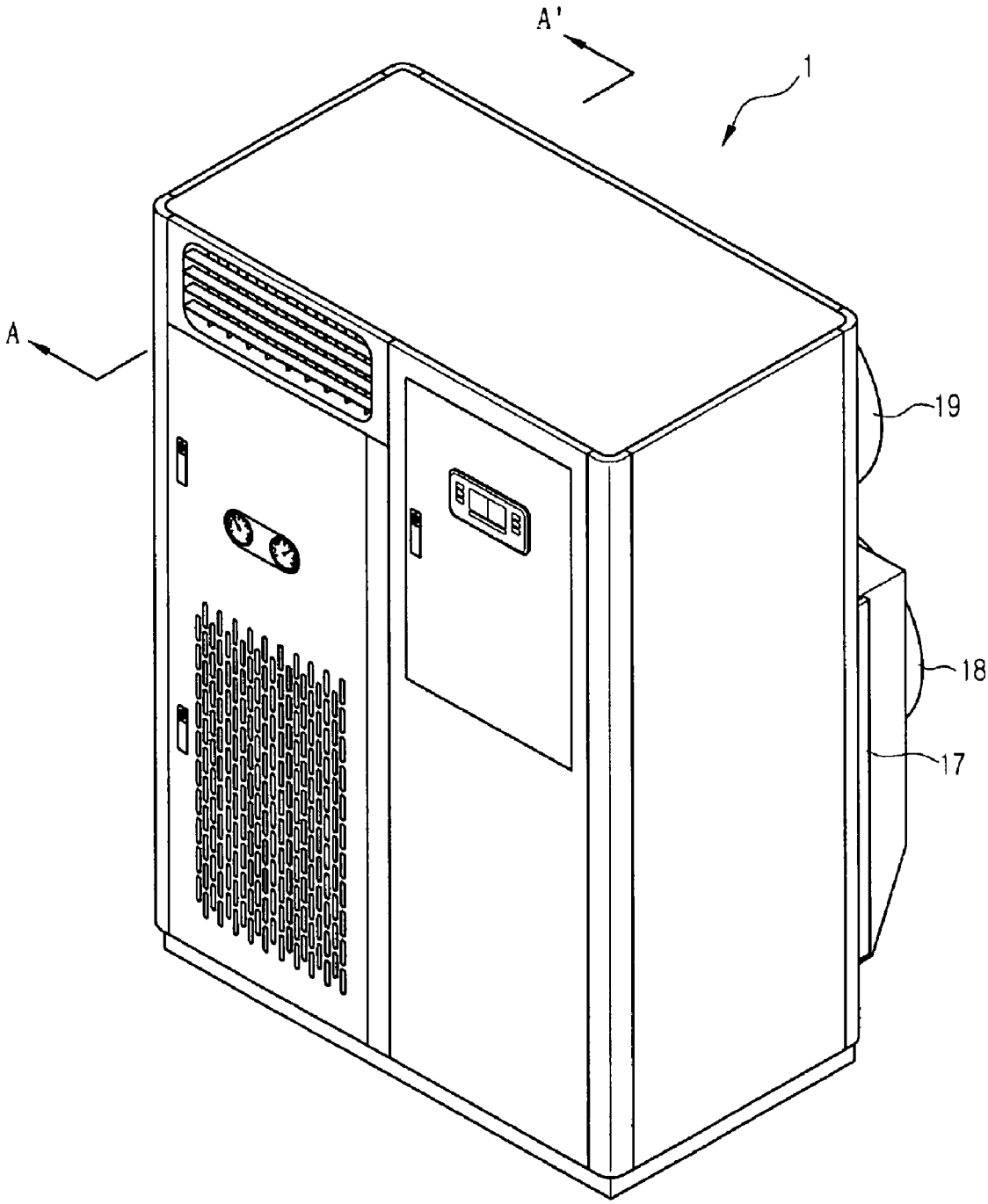

[Fig. 3]
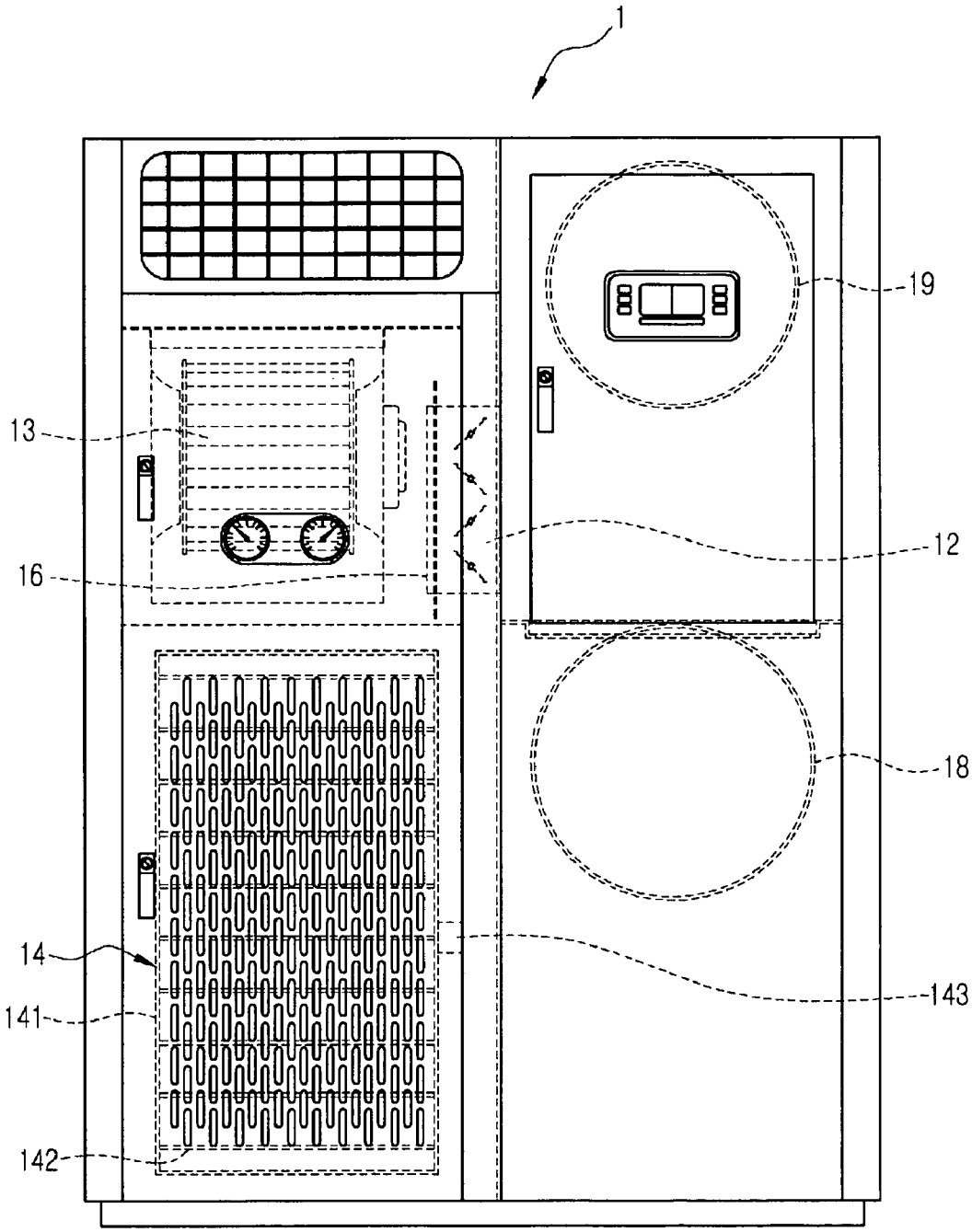

[Fig. 4]
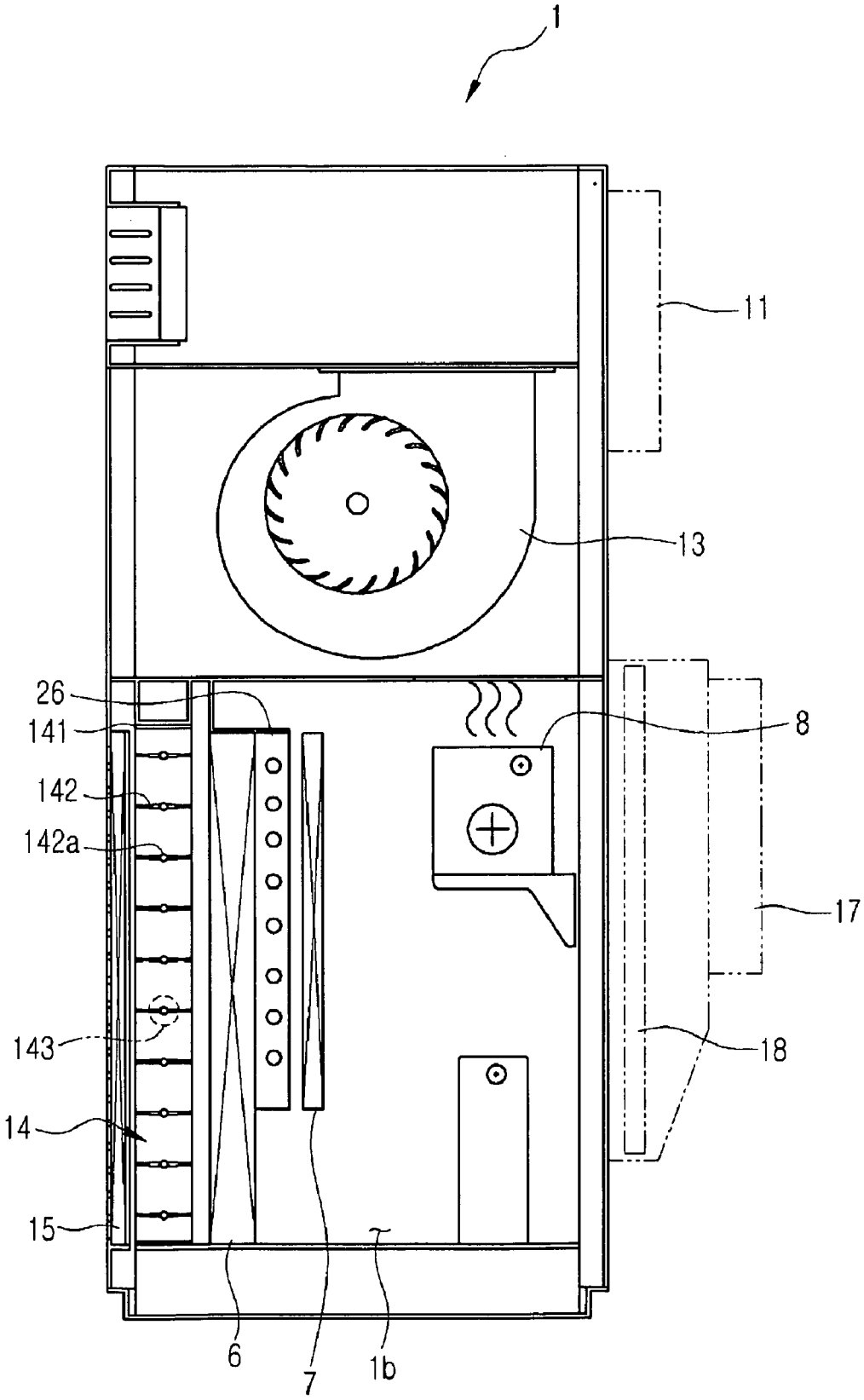

[Fig. 5]
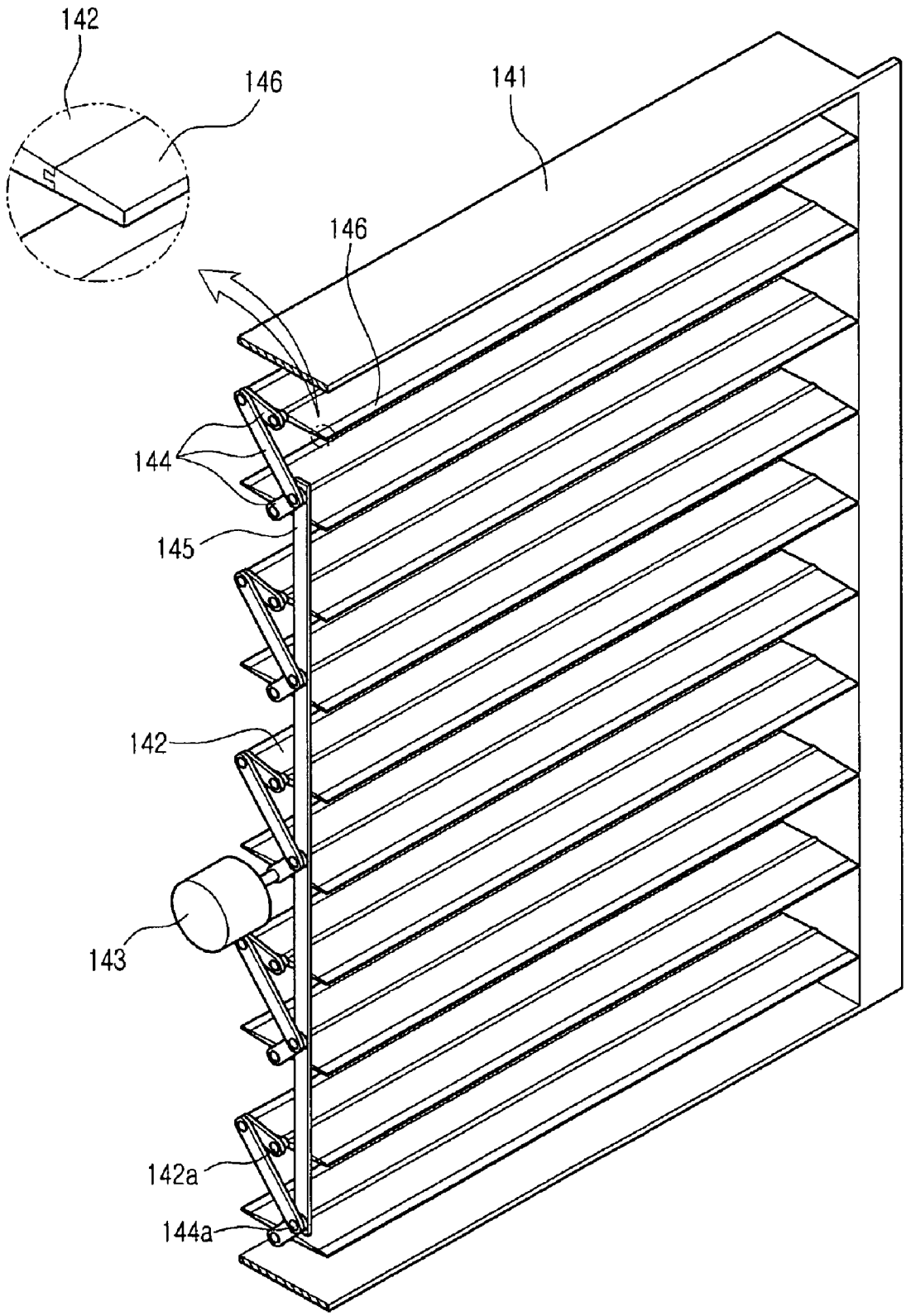

[Fig. 6]
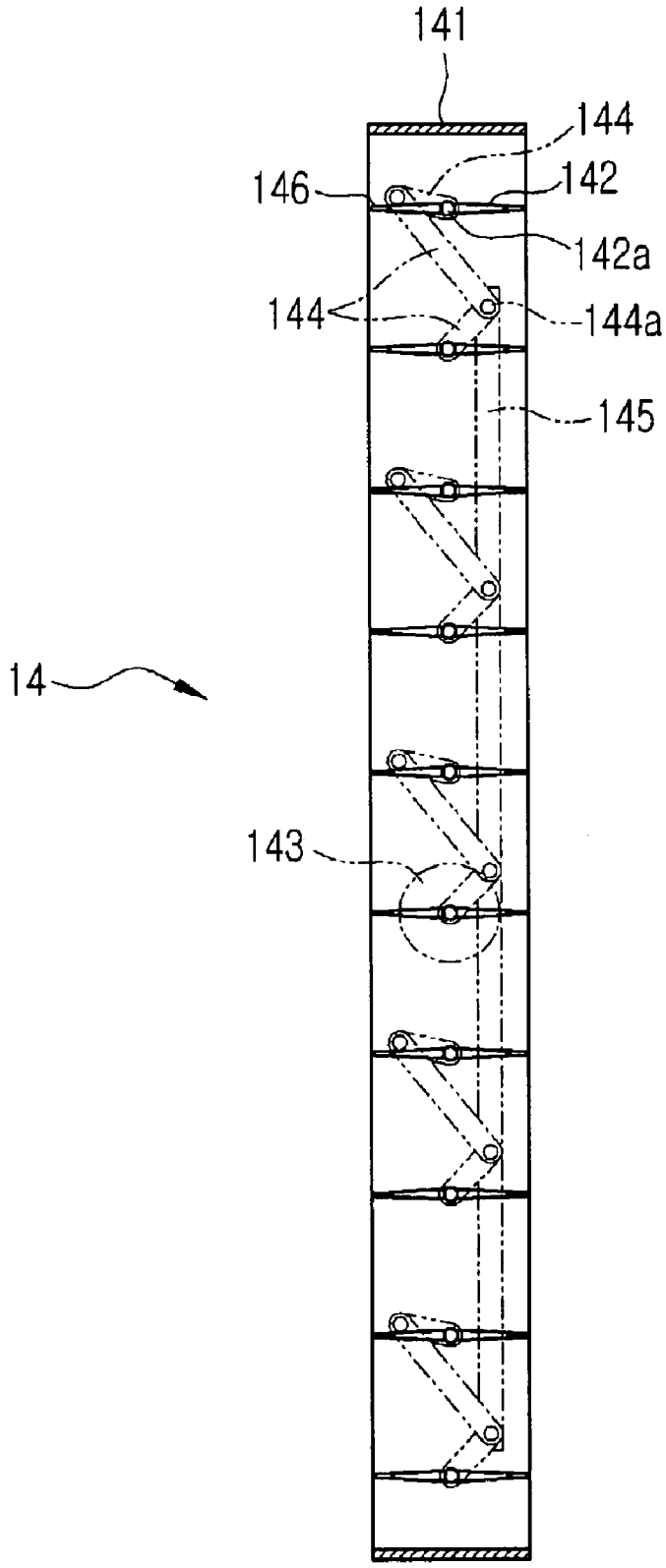

[Fig. 7]
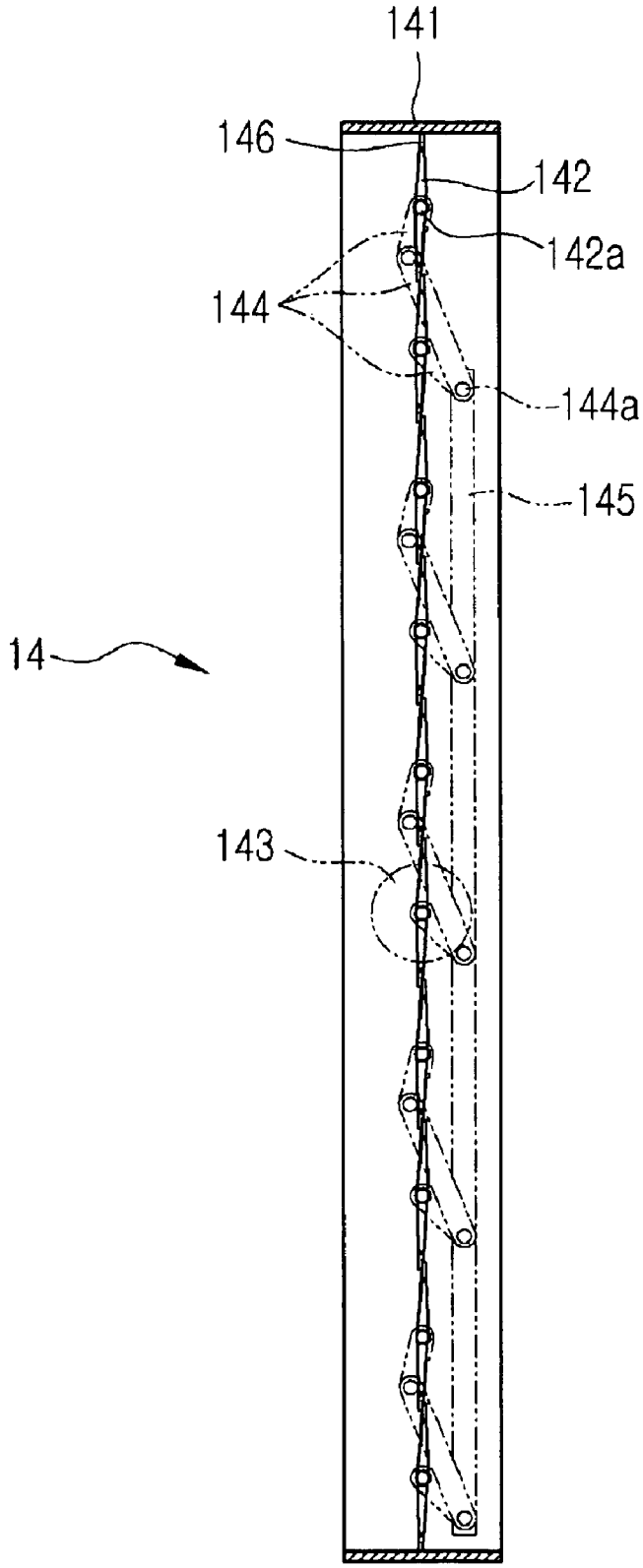

AIR COOLING DEVICE OF INTEGRATED THERMO-HYGROSTAT

RELATED APPLICATIONS

This application is a 371 application of International Application No. PCT/KR2007/005270, filed Oct. 25, 2007, which in turn claims priority from Korean Patent Application No. 10-2006-0104832, filed Oct. 27, 2006, both of which are incorporated herein by reference.

TECHNICAL FIELD

The present invention relates, in general, to an air cooling device of an integrated thermo-hygrostat, and, in particular, to an air cooling device of an integrated thermo-hygrostat having a structure in which a compressor, which is an indoor unit known in the art and compresses refrigerant, and machines such as a condenser, which emits heat, and is an outdoor unit in the known arts, are installed in a single main body, and in which an indoor air control damper, controlling the flow of indoor air, and an outdoor air control damper, controlling the flow of outdoor air, are separately installed in front of an evaporator, into which the indoor air is introduced, and on a barrier, which divides the inside space of the main body into an inner portion and an outer portion, respectively. With this structure, the air cooling device operates in a manner such that the indoor air control damper is opened but the outdoor air control damper is closed, and thus the outdoor air cools the condenser and is then discharged outside, and the indoor air is cooled by the evaporator and is then blown into the indoor space when the temperature of the indoor air and the outdoor air is equal to or higher than a predetermined temperature, such as during summer, and thus a cooling operation must be performed. Conversely, the air cooling device operates in a manner such that the indoor air control damper is closed, the operation of the cooling function of the thermo-hygrostat is suspended, and the outdoor air control damper is opened, and thus fresh outdoor air having a temperature lower than the predetermined temperature is directly introduced into the indoor space after being filtered by passing through filters, so that the indoor air is cooled by natural air cooling when the temperature of the outdoor air is lower than a predetermined temperature, such as during the winter. Thus, the air cooling device is advantageous in that it is possible to rapidly decrease the temperature of the indoor air to the intended temperature and prevent unnecessary power from being consumed. That is, it is possible to realize a power-saving effect because it is possible to cool the indoor air using outdoor air (natural air), which has a temperature equal to or lower than a predetermined temperature, without driving a cooling part of a thermo-stat.

BACKGROUND ART

A major requirement for ancient people throughout human history has been to endure cold weather, rather than to endure heat.

Accordingly, people first invented heating means and then developed and have used cooling means for a long time since the start of use of the heating means. The developed apparatus, which blows out controlled cool air, was first called an air controlling device, i.e. an air conditioner.

However, the air conditioner in the early stages was just a simple cooler in practice. After that, cooling and heating, performed in summer and winter, respectively, became known as summer air conditioning and winter air conditioning, respectively. However, recently, both the cooling and the heating are together referred to as air conditioning.

Generally, air conditioning is performed for the purpose of creating agreeable conditions for people living or working in houses, hotels, offices, halls, data processing centers, and various job sites by maintaining conditions such as temperature, humidity, sanitation, smell, and airflow in an indoor space so as to be in a state suitable for the use of the indoor space. Air conditions that are agreeable to people depend on various factors such as climate, clothing, the standard of living, and the condition of people's health. Accordingly, agreeable air conditions are not fixed values but are assumed to fall within a temperature in a range from 26° C. to 28° C. and relative humidity of about 50% in summer and a temperature in a range from 20° C. to 22° C. and relative humidity of about 40% in the winter.

However, such values are not fixed values, but vary according to the products produced, processed or tested in spaces such as offices, storehouses, laboratories, or data processing centers, or according to kinds of machines installed in such spaces so that products and machines can satisfactorily perform their own functions.

In a tobacco factory, it is preferable that the factory be maintained at high humidity so that tobacco leaves do not break down into powder due to dryness. On the other hand, it is preferable that low temperature be maintained in a chocolate factory in order to prevent chocolate from melting, otherwise the shapes of the chocolates will collapse. Further, a transistor manufacturing factory must be maintained under a condition of low dust. A physiology clinic or laboratory will be maintained under a condition in which airflow is slow, taking the effect of wind on people's lives into consideration. That is, air conditioning is performed in order to prevent the quality of products from varying or defective products from being produced.

In particular, when air conditioning is applied to industries, for example, to product treatment procedures requiring the condition in which constant temperature and humidity must be maintained, or to product storing procedures, it is necessary to control humidity as well as temperature (cooling and heating). For this purpose, a thermo-hygrostat, which can perform air conditioning, is a device used for maintaining the temperature and humidity of an indoor space at preset levels. The thermo-hygrostat includes a cooler, which supplies cold air, a hot air blower, which supplies hot air, and a humidifier, which maintains the humidity of indoor air. The cooler includes an evaporator, a condenser, a pump, and valves, and cold air is generated by the evaporator by forming a cooling cycle. The hot air blower supplies hot air, generated by a hot wire, into the indoor space. The humidifier evaporates water using a heat pipe dipped in water, or generates vapor by heating water by electrical conduction using the electrical conductivity of water, thereby adjusting the humidity in the indoor space.

The known thermo-hygrostat is a device used for maintaining the temperature and the humidity at a preset constant level, and is generally installed and used in a room (indoor space) in which high precision controllers or expensive communication machines, which are very sensitive to fluctuations in temperature and humidity, are installed, or in various spaces such as laboratories or data processing centers, thereby preventing various machines from malfunctioning and enabling such machines to stably perform their own functions.

The known thermo-hygrostat employs a controller (called a hot gas controller), parts needed for performing cooling and heating, and parts needed for performing de-humidifying and humidifying, and those elements are integrated into a single system. The thermo-hygrostat is structured in a manner such that cooling, heating, dehumidifying, and humidifying operations are automatically performed by a controller when the temperature or humidity of the room falls outside of the error range of the preset temperature or the preset humidity by detecting the temperature and the humidity in the room using the controller.

For most known thermo-hygrostats, the evaporator, which absorbs heat, is installed in an indoor space so as to be in contact with sucked air, and the compressor, compressing refrigerant, and the condenser, emitting the absorbed heat, are installed in an outdoor space. Accordingly, it is difficult to install the thermo-hygrostat in some instances. Further, an installation space must be provided on the outer wall of a building in order to install outdoor units and refrigerant pipes and to enable the power line connection work to be done. Accordingly, high costs are incurred. Still further, there is the probability of a fire occurring due to the work of welding the refrigerant pipes. Yet further, antifreeze is used to prevent the refrigerant pipes from rupturing in cold weather, which results in environmental pollution.

In order to solve such problems, the applicant of the present application has invented a variety of types of improved thermo-hygrostats, including an integrated thermo-hygrostat (Korean Utility Model Registration No. 20-193266), in which both a compressor, which compresses refrigerant and is typically an indoor unit, and parts such as a condenser emitting heat, which are typically outdoor units, are installed in a single main body, and various modifications thereof, such as Korean Utility Model Registration Nos. 20-359675 and 20-259280, and Korean Patent Nos. 10-414030 and 10-538455.

The integrated thermo-hygrostats are advantageous over the known thermo-hygrostat in that they are easy to install and it is possible to save installation costs incurred to install the outdoor units, to decrease installation time, to minimize maintenance fees, to prevent fires from occurring thanks to the obviation of the requirement to weld refrigerant pipes, to eliminate the risk of rupture of the refrigerant pipes because a water refrigerant pipe is not used, and to prevent air pollution attributable to the use of antifreeze.

Among the known integrated thermo-hygrostats, the integrated thermo-hygrostat disclosed in Korean Utility Model Registration No. 20-193266 has a structure in which an outdoor air damper is provided to a barrier, which divides the space of the main body into an inner portion and an outer portion in order to control the flow of outdoor air introduced into the outer portion. Thanks to this structure, the cooling of an indoor space can be performed using only the outdoor air in winter and thus it is possible to reduce the cooling load and to decrease power consumption compared to a device that performs a cooling operation using only a cooling system.

This thermo-hygrostat has a structure in which the outdoor air damper, which can control the flow of the outdoor air introduced into the outer portion of the main body, is provided to the barrier, which simply divides the inside space of the main body into the inner portion and the outer portion, and the outdoor air is forcibly introduced into the indoor space in winter. Accordingly, some of the indoor air passes through a grill disposed in front of the condenser and is returned to the indoor space along with the outdoor air when a fan is driven and the outdoor air damper is opened. At this time, the indoor air, having passed through the grill, is mixed with the outdoor air, having passed through the outdoor air damper, and is then forcibly introduced into the indoor space.

That is, the thermo-hygrostat, having a structure in which the outdoor air damper, which controls the flow of the outdoor air, is provided to the barrier, which divides the inner space of the main body into the inner portion and the outer portion, is not provided with any means to control the flow of the indoor air introduced into the inner portion of the main body. Accordingly, when the outdoor air damper is opened and the fan is driven in order to cool the indoor air using the outdoor air (natural air), which has a temperature equal to or lower than a predetermined temperature, some of the indoor air, which has a higher temperature than the outdoor air, is introduced into the inner portion of the main body through the grill provided to the front portion of the condenser, mixed with the outdoor air passed through the outdoor air damper, and then forcibly sent to the indoor space. Thus, the air that is introduced into the indoor space in practice has a higher temperature than the outdoor air, thus decreasing cooling efficiency. For this reason, if the temperature of the indoor space is not lowered to the intended temperature even when the cooling is performed by forcibly sucking the outdoor air, the cooler part of the thermo-hygrostat must intermittently and repeatedly operate in order to lower the temperature of the indoor space to the intended temperature. In this case, there is a problem in that the cooling load and power consumption are not greatly reduced. Disclosure of Invention Technical Problem The present invention has been devised in view of the various problems described above, and an object of the invention is to provide an integrated thermo-hygrostat having a structure in which a compressor, which is a general indoor unit known in the art and compresses refrigerant, and machines, such as a condenser emitting heat, which are general outdoor units known in the art, are installed in a single main body, and in which an indoor air control damper, which controls the flow of indoor air, and an outdoor air control damper, which controls the flow of outdoor air, are separately installed in front of an evaporator, into which the indoor air is introduced, and on a barrier, which divides the inside space of the main body into an inner portion and an outer portion, respectively. Thanks to this structure, the air cooling device operates in a manner such that, when the indoor air control damper is opened but the outdoor air control damper is closed, the outdoor air cools the condenser and is then discharged outside and the indoor air is cooled by the evaporator and is then blown into the indoor space when the temperatures of the indoor air and the outdoor air are equal to or higher than a predetermined temperature, such as during summer, when a cooling operation needs to be performed. Conversely, the air cooling device operates in a manner such that, when the indoor air control damper is closed, the operation of the cooling function of the thermo-hygrostat is suspended, and the outdoor air control damper is opened, fresh outdoor air having a temperature lower than the predetermined temperature is directly introduced into the indoor space after being filtered by passing through filters so that the indoor air is cooled by natural air cooling when the temperature of the outdoor air is lower than the predetermined temperature, such as in winter. Thus, the air cooling device is advantageous in that it is possible to rapidly decrease the temperature of the indoor air to the intended temperature and prevent power from being unnecessarily consumed. That is, it is possible to achieve a power-saving effect because it is possible to cool the indoor air using outdoor air (natural air) having a temperature equal to or lower than a predetermined temperature without driving a cooling part of a thermo-stat. Technical Solution In order to accomplish such objects, there is provided an air cooling device of an integrated thermo-hygrostat having a main body divided into an inner portion and an outer portion by a vertical barrier, in which a compressor, compressing refrigerant, a condenser, connected to the compressor, and an air exhaust fan are installed in the outer portion, and an air filter, an expansion valve, an evaporator, a heater, a humidifier, a liquid heat exchanger, a double-pipe condenser, a refrigerant dryer, an indoor air control damper, and a fan are installed in the inner portion, in which an indoor air control damper is installed in front of the evaporator, which can control the flow of indoor air, thereby preventing some of the indoor air from being mixed with outdoor air when an indoor space having a high temperature is cooled using cold outdoor air in the winter.

In the air cooling device of a thermo-hygrostat, it is preferable that the outdoor air control damper and the indoor air control damper operate in a manner such that the indoor air control damper is opened but the outdoor air control damper is closed when the temperatures of the indoor air and the outdoor air are equal to or higher than a predetermined temperature, such as during summer, when the cooling function of the device is performed. In such a case, the outdoor air cools down the condenser and is then discharged out of the main body, and the indoor air is cooled by the evaporator and is then sent to the indoor space.

In the air cooling device of a thermo-hygrostat, it is preferable that, when the temperature of the outdoor air is equal to or lower than the predetermined temperature, such as in winter, the indoor air control damper be closed, the operation of the cooling function be suspended, and the outdoor air control damper be opened. Thus, the fresh outdoor air having a temperature equal to or lower than the predetermined temperature is directly introduced into the indoor space after being filtered by a filter using the fan. That is, natural air cooling is performed.

In the air cooling device of a thermo-hygrostat, it is preferable that, in the middle of performing a heating function of the device in winter mode, during which the indoor air control damper is closed, the outdoor air control damper is opened, and heating is performed using the air introduced from the outside, if the temperature of the indoor space is increased to the predetermined temperature, the indoor air control damper be opened, the outdoor air control damper be closed, and the cooling function be performed, as in summer mode. The winter mode and the summer mode are alternately performed.

In the air cooling device of a thermo-hygrostat, it is preferable that the indoor air control damper include a rectangular frame, front and back sides of which are open, a plurality of wings disposed inside the rectangular frame at regular intervals and pivotably coupled to the rectangular frame at both ends thereof by shafts, a servomotor having a body fixed to the front surface of the inner portion of the main body and a shaft coupled to the shaft pivotably supporting any one of the wings and generating driving force needed to open and close the wings by a rotary motion thereof in forward and backward directions, and a plurality of links arranged in one step or in two steps, between the shafts pivotably supporting the corresponding wings and a bar, in which, when the servo-motor is driven in the state in which free ends of the links, arranged in one step or two steps, are pivotably coupled to each other and supported by shafts, the shafts of the wings, which are coupled to the links, rotate in response to the driving direction of the servo-motor and thus the corresponding links coupled to the shafts of the corresponding wings, which are rotated, at their first ends, rotate, which causes upward or downward linear motion of adjacent links and thus causes the links connected to different wings to rotate in an opening direction or a closing direction.

In the air cooling device of a thermo-hygrostat, it is preferable that, when connecting the shafts of the wings to the bar using the links installed in one step or two steps, the free ends of two links, adjacent to each other, be pivotably coupled to one spot of the bar by a shaft, and thus the wings, adjacent to each other, rotate in opposite directions when the wings are opened and closed in response to the driving direction of the servo-motor.

In the air cooling device of a thermo-hygrostat, it is preferable that each of upper and lower ends of the wings be provided with a sealing rubber bar.

BRIEF DESCRIPTION OF THE DRAWINGS

FIG. 1 is a block diagram illustrating the overall structure of an integrated thermo-hygrostat provided with the air cooling device according to one embodiment of the invention;

FIG. 2 is a perspective view illustrating the integrated thermo-hygrostat provided with the air cooling device according to one embodiment of the invention;

FIG. 3 is a front view illustrating the integrated thermo-hygrostat provided with the air cooling device according to one embodiment of the invention;

FIG. 4 is a sectional view taken along line A-A' shown in FIG. 2;

FIG. 5 is a partial sectional view illustrating an indoor air control damper of the air cooling device according to one embodiment of the invention;

FIG. 6 is a side sectional view illustrating the indoor air control damper in an open state; and FIG. 7 is a side sectional view illustrating the indoor air control damper in a closed state.

BRIEF DESCRIPTION OF KEY ELEMENTS IN THE DRAWINGS

1: body 1*a*: barrier
1*b*: outer portion 1*c*: inner portion
2: compressor 3: condenser
4: air exhaust fan 5: expansion valve
6: evaporator 7: heater
8: humidifier 9: liquid heat exchanger
10: double-pipe condenser 11: refrigerant dryer
12: outdoor air control damper 13: fan
14: indoor air control damper 15, 16: air filter
17: foreign matter filtering filter
18: suction duct 19: exhaust duct
20: electronic valve
21: outdoor air temperature detecting sensor
22: side glass 23: low pressure filter
24: temperature and humidity detecting sensor
25: hot gas electronic valve 26: reheating coil
27: check valve 28: water supply line
29: waterproof electronic valve
141: rectangular frame 142: wing
143: servo-motor 144: link
145: bar 146: sealing rubber bar
142*a*, 144*a*: shaft

BEST MODE FOR CARRYING OUT THE INVENTION

Embodiments of the invention will be described below with reference to the accompanying drawings.

FIG. 1 is a block diagram illustrating the overall structure of an integrated thermo-hygrostat to which an air cooling device according to one embodiment of the invention is applied. FIG. 2 is a perspective view illustrating the integrated thermo-hygrostat to which the air cooling device according to one embodiment of the invention is applied. FIG. 3 is a front view illustrating the integrated thermo-hygrostat to which the air cooling device according to one embodiment of the invention is applied. FIG. 4 is a sectional view taken along line A-A' shown in FIG. 2.

FIG. 5 is a partially cut sectional view illustrating an indoor air control damper of the air cooling device according to one embodiment of the invention. FIG. 6 is a side sectional view illustrating the indoor air control damper which is in the opened state. FIG. 7 is a side sectional view illustrating the indoor air control damper which is in the closed state.

According to the drawings, the air cooling device according to one embodiment of the invention includes a main body 1 the inner space of which is divided into an outer portion 1*b* and an inner portion 1*c* by a barrier 1*a*. The air cooling device further includes a compressor 2, compressing refrigerant, a condenser 3, connected to the compressor 2, and an air discharge fan 4, which are installed in the outer portion 1*b*. The air cooling device still further comprises an air filter 15, an expansion valve 5, an evaporator 6, a heater 7, a humidifier 8, a liquid heat exchanger 9, a double-pipe condenser 10, a refrigerant dryer 11, an outdoor air control damper 12 provided with an air filter 16, and a fan 13, which are installed in the inner portion 1*c*.

An indoor air control damper 14 is additionally installed in front of the evaporator 6 installed in the inner portion 1*c* so as to control the flow of the air which was introduced from an indoor space and passes through the air filter 15. With this structure, it is possible to prevent some of the indoor air, mixed with the outdoor air, from being returned to the indoor space by the fan 13 when cooling the indoor space, which has a high temperature, using cold outdoor air in winter.

For this instance, the outdoor air control damper 12 is closed and the indoor air control damper 14 is opened when cooling function is performed under a condition in which the temperature of the indoor air and the outdoor air is equal to or higher than a predetermined temperature (for example, 21 to 22° C.) as in summer. Thanks to this operation, the outdoor air is returned to the outdoor space by the air exhaust fan 4 after cooling the condenser 3, and the indoor air is returned to the indoor space after being cooled by the evaporator 6. This operation is repeated.

Conversely, under a condition in which the temperature of the outdoor air is equal to or lower than a predetermined temperature (for example, 13° C.), as in winter, the indoor air control damper 14 is closed, the operation of the cooling function is suspended, and the outdoor air control damper 12 is opened. As a result, fresh outdoor air having a temperature equal to or lower then the predetermined temperature is filtered while passing through the foreign matter filtering filter 17 on the condenser side and the air filter 16 provided to the outdoor air control damper 12, and is then directly introduced into the indoor space. That is, natural air cooling is accomplished.

In addition, in the middle of performing a heating operation for heating the indoor space using the air introduced from the outside in the state in which the indoor air control damper 14 is closed and the outdoor air control damper 12 is opened in this winter mode, if the temperature of the indoor space becomes equal to or higher than the predetermined temperature (for example, 21 to 22° C.), the indoor air control damper 14 is opened, the outdoor air control damper 12 is closed, and the operation of the cooling function is suspended, as in summer mode. These operations are repeated so as to maintain the temperature of the indoor space below the predetermined temperature (for example, 21 to 22° C.).

Meanwhile, the indoor air control damper 14 includes a rectangular frame 141 the front and back side of which are open, a plurality of wings 142 disposed inside the frame 141, arranged at regular intervals, extending in lateral directions, and pivotably coupled to the frame by shafts at both ends thereof, a servo-motor 143, having a body 1 fixed to the front-side surface of the inner portion 1*b* and a shaft coupled to any one of the shafts 142*a* of the wings 142 and producing driving force needed to open and close the wings 142 by rotary motion thereof in backward and forward directions, a plurality of links 144 pivotably coupled to the shafts 142*a* of the wings 142 and a bar 145 in a one-step form or a two-step form, and a bar 145, to which free ends of the links 155 are pivotably coupled in a one-step form or a two-step form by shafts 144*a*. When the servo-motor 143 is driven, the shaft 142*a* of the wing 142 coupled to the servo-motor 143 rotates in response to the driving direction of the servo-motor 143. Accordingly, the link 144 having the end coupled to the shaft 142*a* of the corresponding wing 142 rotates, which leads to upward or downward linear motion of the corresponding link 144. The upward or downward linear motion of the corresponding link 144 brings about the rotation of other links 144 connected to other wings 142. As a result, the wings 142 rotate in an opening direction or a closing direction.

In this instance, in the case in which the links 144 connected to the shafts 142*a* of the wings 142 in a one-step form or a two-step form are connected to the bar 45, the free ends of two links 144, which are adjacent to each other and are connected to different wings 142 adjacent to each other in a one-step form or two-step form, are pivotably coupled to the bar at one point, and thus the wings 142, adjacent to each other, are opened or closed by rotating in opposite directions when the wings 142 are opened or closed in response to the driving direction of the servo-motor 143.

Each of the upper and lower ends of the wings 142 is provided with a sealing rubber bar 146, and thus it is possible to prevent a gap from being formed between the wings 142, which are adjacent to each other, when the wings 142 rotate in the closing direction, thanks to the tight contact of the sealing rubber bars 146.

Advantageous effects of the air cooling device according to the invention will be described below.

The device of the invention is technically differentiated from the known integrated thermo-hygrostat shown in FIG. 1 in that the indoor air control damper 14 is additionally installed in front of the evaporator 6 installed in the inner portion in the main body 1, and thus it is possible to prevent the indoor air from being introduced into the main body through the air filter 15 and the condenser 3, from being mixed with the cold outdoor air, and from then being returned to the indoor space by the fan 13 when the indoor space is cooled by sucking the cold outdoor air, by opening the outdoor air control damper 12 provided to the barrier 1*a* dividing the main body into the inner portion 1*c* and the outer portion 1*b*.

The inside space of the main body 1 is divided into the inner portion 1*b* and the outer portion 1*b* by the vertical barrier 1*a*. In the outer portion 1*b*, the compressor 2, compressing refrigerant, the condenser 3, connected to the compressor 2, and the air exhaust fan 4 are installed. In the inner portion 1*c*, the air filter 15, the expansion valve 5, the evaporator 6, the heater 7, the humidifier 8, the liquid heat exchanger 9, the double-pipe condenser 10, the refrigerant dryer 11, the outdoor air control damper 12, provided with the air filter 15, and the fan 13 are installed.

A suction duct 18 and a discharging duct 19, installed at the back of the outer portion 1*b* of the main body 1, are exposed to the air through window of a building. The ducts 18 and 19 are made of corrugated pipe and thus it is possible to adjust the length of the ducts 18 and 19 to match the distance between the main body 1 and the window of the building. Thanks to this structure, it is also possible to easily install the ducts 18 and 19 even in the case in which the heights of the window of the building and the location of the ducts 18 and 19 are different, because the ducts 18*a* and 19 can bend.

In the state in which the main body 1 is installed in the above-described manner, in most of the seasons in which the temperature of the outdoor air is relatively high, except for winter, the outdoor air control damper 12 is closed and the indoor air control damper 14 is opened. In this state, the cooling operation is started. After the cooling operation is started, the refrigerant in the compressor 2 is introduced into the condenser 3 and becomes hot. The hot refrigerant in the condenser 3 is condensed by the outdoor air that has been sucked into the suction duct 18 by the air exhaust fan 4 installed in the discharging duct 19, and the outdoor air, which has thus come to have a high temperature, is then discharged out of the building through the discharging duct 19

On the other hand, since the foreign matter filtering filter 17 is installed in the suction duct 18, foreign matter is screened from the outdoor air.

The refrigerant which has passed through out of the condenser 3 is separated into liquid and gas while passing through the double-pipe condenser 3, and the refrigerant passing out of the double-pipe condenser 3 rapidly come to expand and have a low temperature while passing through the liquid heat exchanger 9, the electronic valve 20 and the expansion valve 5. The low temperature refrigerant in an expanded state is introduced into the evaporator 6 in the inner portion 1*c*, and is then sent to the indoor space by the fan 13.

The refrigerant which has passed thorough out of the double-pipe condenser 3 and the liquid heat exchanger 9 enters the refrigerant dryer 11, which screens impurities from the refrigerant and then further passes by the side glass 22 through which the flow of the refrigerant is visible.

The low temperature refrigerant in the evaporator 6 exchanges heat with the room temperature air and then returns to the compressor 2. At this time, impurities in the refrigerant are filtered by a lower pressure filter 23 connected to the compressor 2 and thus the refrigerant becomes clean.

In the case in which the relative humidity of the indoor space is equal to or higher than preset humidity, a temperature/humidity detecting sensor 24 detects this condition, and thus cooling and dehumidifying are simultaneously performed. During this procedure, the hot gas electronic valve 25 is opened, and heat of condensation, generated during the dehumidifying operation is heat-exchanged with a reheating coil 26. As a result, the temperature in the indoor space, which is lowered, is increased to and maintained at the set temperature.

When the temperature of the indoor space reaches the set temperature by such operation, the hot gas electronic valve 25 is closed, and the cooling operation continues according to the above-described procedure. The refrigerant is condensed and liquefied after passing through the reheating coil 26, and is then introduced into the liquid heat exchanger 9. During this procedure, a check valve 27 prevents the refrigerant from flowing backward into the condenser 3.

Further, if the temperature of the indoor space becomes equal to or lower than the preset temperature during the cooling operation, the cold indoor air and the heater 7 exchange heat with each other, thereby increasing the temperature of the indoor space to the preset temperature and thus maintaining the preset temperature.

When the humidity of the indoor space is equal to or lower than the preset humidity, a waterproof electronic valve 29 is opened and water is supplied to an outer coil of the double-pipe condenser 3. Hot water, resulting from the heat-exchange with the outer coil of the double-pipe condenser 3, is supplied to the humidifier 8 while a temperature of about 80° C. is maintained. The hot water in the humidifier 8 is heated to 100° C. by a heater, and then humidifying is performed. Accordingly, it is possible to maximize humidifying efficiency at low power.

In addition to the outdoor air control damper 12 provided to the barrier 1*a*, the device according to the invention includes the indoor air control damper 14 installed in front of the evaporator 6 disposed in the inner portion 1*c*. Accordingly, in winter, when the temperature of the outdoor air is lower than that of the indoor air (for example, when the temperature of the outdoor air is equal to or lower than 13° C.), the outdoor air control damper 12 provided to the vertical barrier 1*a* is opened, the fan 13 is driven, and the indoor air control damper 14 is closed. Accordingly, it is possible to perform cooling of the indoor space using the cold outdoor air.

At this time, the clean outdoor air, filtered by the foreign matter filtering filter 17 of the suction duct 18, is sent to the indoor space through the outdoor air control damper 12. Accordingly, it is possible to perform a cooling operation and to control the temperature of the indoor space with little power.

In addition, in such cold weather, as in winter, since the indoor air control damper 14 is automatically closed when the outdoor air control damper 12 is opened when intending to cool the hot air in the indoor space, it is possible to perfectly prevent some of the indoor air from being mixed with the outdoor air and introduced into the indoor space when the outdoor air is introduced into the indoor space through the opened outdoor air control damper 12 using the fan 13. Accordingly, it is possible to prevent cooling efficiency from decreasing, attributable to the event in which the indoor air is mixed with the outdoor air.

The integrated thermo-hygrostat employing the air cooling device according to the invention repeats the operations by which the indoor air is cooled by the condenser 3 and is then discharged outside the building by the air exhaust fan 4 and the indoor air is cooled by the evaporator 6 and is then sent to the indoor space by the fan 13 in the state in which the indoor air control damper 14 is opened and the outdoor air control damper 12 is closed like the known integrated thermo-hygrostat in the case in which the temperature of the indoor air and the outdoor air is equal to or higher than a predetermined temperature (for example, 21 to 22° C.), as in summer, and the cooling function is performed.

However, in the case in which the temperature of the outdoor air is equal to or lower than a predetermined temperature (for example, 13?), as in winter, on the basis of the result whereby the outdoor air temperature detecting sensor 21 installed in the suction duct 18 detects the outdoor air temperature, the indoor air control damper 14 is closed, the operation of the cooling function is suspended, the outdoor air control damper 12 is opened, and the fan is driven so that the fresh outdoor air having a temperature equal to or lower than the predetermined temperature is filtered by passing through the foreign matter filtering filter 17 on the condenser side and the air filer 16 on the outdoor air control damper side, and is then directly introduced into the indoor space, i.e. natural cooling is performed. Accordingly, it is possible to dramatically enhance the power-saving effect and cooling efficiency compared to the known integrated thermo-hygrostat, in which some of the indoor air is mixed with the outdoor air when performing cooling using the outdoor air in winter because the known integrated thermo-hygrostat includes only the outdoor air control damper 12.

Further, even in the middle of performing heating of the indoor space using the outdoor air introduced from the outside in the state in which the indoor air control damper 14 is closed and the outdoor air control damper 12 is opened in the cooling mode in winter, it is possible to always maintain the temperature of the indoor space at a constant level (for example, 21 to 22° C.) by performing the cooling function after opening the indoor air control damper 14 and closing the indoor air control damper 12, as in the summer mode, if the temperature of the indoor space become equal to or higher than the predetermined temperature (for example, 21 to 22° C.)

As shown in FIG. 5, the indoor air control damper 14 used in this invention includes the rectangular frame 141, the wings 142, the links 144, the servo-motor 143, and the bar 145. The rectangular frame 141 is open at the front side and the back side and is installed in front of the evaporator 6 installed in the inner portion 1*c* of the main body.

The wings 142 extend in lateral directions and are arranged at regular intervals inside the frame 141. Both ends of each of the wing 142 are pivotably coupled to the frame 141 by the shaft 142*a*. The wing 142 pivots by an angle in the range of 0 to 180 degree. The servo-motor 143 is installed in a manner such that the body thereof is fixed to the front-side surface of the inner portion 1*b* of the main body and the shaft thereof is coupled to any one of the shafts 142*a* of the wings 142. The servo-motor 143 generates driving force needed to open and close the wings 142 by the rotary motion in a forward direction.

Each of the upper and lower ends of the wings 142 is provided with the sealing rubber bar 146 so that it is possible to prevent a gap from being formed between adjacent wings 142 when the wings 142 rotate in the closing direction by the tight planar contact of the sealing rubber bars 146 provided to the adjacent wings 142. As a result, it is possible to prevent the indoor air from being introduced through the gap between the wings 142 and to prevent the ends of the wings 142 from being damaged or breaking due to the collision of the adjacent wings 142.

The plurality of links 144 are connected in a one-step form or a two-step form, in which first ends (fixed ends) of the links 144 are coupled to the shafts 142*a* of the wings 142 and second ends (free ends) are pivotably coupled to the bar 145 using the shafts 144*a*. The links 144, connected between the wings 142 and the bar 145, are pivotably coupled to respective wings 142. Accordingly, if all of the wings 142 are installed so as to be opened or closed in one direction (the same direction) in response to the driving direction of the servo-motor 143, the length of each link 144 must be sufficiently long in proportion to the width of the wings 142, so that the wings 142 can be completely opened and closed. This requires a large sized rectangular frame 141.

Accordingly, in order to overcome this problem, the invention provides a structure in which the second ends (free ends) of two links 142 adjacent to each other and respectively connected to different wings 142 which are adjacent to each other, in one step or two steps, are pivotably coupled to one location on the bar 145 in the connection structure of the shafts 142*a* of the wings 142 and the bar 145 by the links 144. Thanks to this structure, when the wings 142 are opened or closed in response to the driving direction of the servo-motor 143, the wings adjacent to each other can be opened or closed by rotating in opposite directions, as indicated by the arrows in FIG. 6. Thanks to this structure, it is possible to decrease the width of the rectangular frame 141.

The servo-motor 143 is driven to start in the state in which the bar 145 pivotably supports the free ends of the links 144 in one step or two steps by the shafts 144. Accordingly, the shafts 142*a* of the wings 142 rotate in response to the driving direction of the servo-motor 143, and thus the corresponding links 144, having the ends fixed to the shafts 142*a* of the corresponding wings 142, rotate and perform upward or downward linear motion in response to the rotating direction of the links 144. This rotates other links 144 connected to other wings 142, and thus the wings 142 rotate in the opening direction or the closing direction in response to the upward or downward linear motion of the links 144. As a result, the wings 142 are opened as shown in FIG. 6, or closed as shown in FIG. 7.

Although a preferred embodiment of the present invention has been described for illustrative purposes, those skilled in the art will appreciate that various modifications, additions and substitutions are possible, without departing from the scope and spirit of the invention as disclosed in the accompanying claims.

As described above, the air cooling device according to the invention has a structure in which a compressor, which is an indoor unit in the known arts and compresses refrigerant, and machines, such as a condenser, which emits heat and is an outdoor unit in the known arts, are installed in a single main body, and in which an indoor air control damper, controlling the flow of indoor air, and an outdoor air control damper, controlling the flow of outdoor air, are separately installed in front of an evaporator, into which the indoor air is introduced, and on a barrier dividing the inside space of the main body into an inner portion and an outer portion, respectively. Thanks to this structure, the air cooling device operates in a manner such that the indoor air control damper is opened but the outdoor air control damper is closed, and thus the outdoor air cools the condenser and is then discharged outside, and the indoor air is cooled by the evaporator and is then blown into the indoor space when the temperatures of the indoor air and the outdoor air are equal to or higher than a predetermined temperature, as in summer, when a cooling operation needs to be performed. Conversely, the air cooling device operates in a manner such that the indoor air control damper is closed, the operation of the cooling function of the thermo-hygrostat is suspended, and the outdoor air control damper is opened, and thus fresh outdoor air having a temperature lower than the predetermined temperature is directly introduced into the indoor space after being filtered by passing through filters, so that the indoor air is cooled by natural air cooling when the temperature of the outdoor air is lower than the predetermined temperature, as in winter. Thus, the air cooling device is advantageous in that it is possible to rapidly decrease the temperature of the indoor air to an intended temperature and prevent power from being unnecessarily consumed. That is, it is possible to achieve a power-saving effect because it is possible to cool the indoor air using outdoor air (natural air) having a temperature equal to or lower than a predetermined temperature without driving a cooling part of a thermo-stat. Accordingly, the invention is very useful from the viewpoint that it is possible to rapidly decrease the temperature of the indoor space to an intended temperature, to increase cooling efficiency, and to decrease power consumption by eliminating unnecessary power consumption in a manner such that the operation of the cooling function is suspended while natural air cooling, using outdoor air having a temperature equal to or lower than a predetermined temperature, is performed.

The invention claimed is:

1. An air cooling device of an integrated thermo-hygrostat having a main body divided into an inner portion and an outer portion by a vertical barrier, in which a compressor, compressing refrigerant, a condenser, connected to the compressor, and an air exhaust fan are installed in the outer portion, and an air filter, an expansion valve, an evaporator, a heater, a humidifier, a liquid heat exchanger, a double-pipe condenser, a refrigerant dryer, an indoor air control damper, and a fan are installed in the inner portion, the air cooling device comprising: an indoor air cooling damper, is installed in front of the evaporator, installed in the inner portion of the main body and can control flow of indoor air, thereby preventing the indoor air from being mixed with outdoor air when cooling indoor space having a high temperature using cold outdoor air in winter.

2. The air cooling device of a thermo-hygrostat according to claim 1, wherein an outdoor air control damper and the indoor air control damper operate in a manner such that the indoor air control damper is opened but the outdoor air control damper is closed when temperatures of the indoor air and the outdoor air are equal to or higher than a predetermined temperature, as in summer, and thus the outdoor air cools down the condenser and is then discharged out of the main body, and the indoor air is cooled by the evaporator and is then sent to the indoor space.

3. The air cooling device of a thermo-hygrostat according to claim 1, wherein, when a temperature of the outdoor air is equal to or lower than the predetermined temperature, as in winter, the indoor air control damper is closed, operation of the cooling function is suspended, and the outdoor air control damper is opened, and thus natural air cooling is performed in a manner such that the outdoor air, which is fresh and has a temperature equal to or lower than the predetermined temperature, is directly introduced into the indoor space after being filtered by a filter using the fan.

4. The air cooling device of a thermo-hygrostat according to claim 1, wherein the indoor air control damper includes: a rectangular frame, front and back sides of which are open; a plurality of wings disposed inside the rectangular frame at regular intervals and pivotably coupled to the rectangular frame at both ends thereof by shafts; a servo-motor having a body fixed to a front surface of the inner portion of the main body and a shaft coupled to the shaft pivotably supporting any one of the wings and generating driving force needed to open and close the wings by a rotary motion thereof in forward and backward directions; and a plurality of links arranged in one step or in two steps between the shafts, pivotably supporting the corresponding wings, and a bar, wherein, when the servo-motor is driven in a state in which free ends of the links arranged in one step or two steps are pivotably coupled to each other and are supported by shafts, the shafts of the wings, which are coupled to the links, rotate in response to a driving direction of the servo-motor, and thus the corresponding links coupled to the shafts of the corresponding wings, which are rotated at their first ends, rotate, which causes upward or downward linear motion of adjacent links and makes the links connected to different wings rotate in an opening direction or a closing direction.

5. The air cooling device of a thermo-hygrostat according to claim 4, wherein, when connecting the shafts of the wings to the bar using the links installed in one step or two steps, the free ends of two links adjacent to each other are pivotably coupled to one spot of the bar by a shaft and thus the wings adjacent to each other rotate in opposite directions when the wings are opened and closed depending on the driving direction of the servo-motor.

6. The air cooling device of a thermo-hygrostat according to claim 5, wherein each of upper and lower ends of the wings is provided with a sealing rubber bar.

* * * * *